United States Patent [19]

Sheehan

[11] Patent Number: 4,803,762

[45] Date of Patent: Feb. 14, 1989

[54] METHOD FOR SPLICING LENGTHS OF FIBER TOW

[75] Inventor: Richard W. Sheehan, Johnson City, Tenn.

[73] Assignee: World Tech Fibres, Inc., Johnson City, Tenn.

[21] Appl. No.: 163,230

[22] Filed: Feb. 26, 1988

[51] Int. Cl.[4] ..... B65H 69/06; D04H 3/10

[52] U.S. Cl. ..... 28/104; 28/283; 156/158

[58] Field of Search ..... 57/22, 23, 202, 350, 57/908; 28/104, 141, 103, 271, 274, 276, 283; 156/157, 158, 502, 509

[56] References Cited

U.S. PATENT DOCUMENTS

| | | | |
|---|---|---|---|
| 3,306,020 | 2/1967 | Rosenstein | 57/22 |
| 3,339,362 | 9/1967 | Dodson, Jr. et al. | 57/159 |
| 3,474,615 | 10/1969 | Irwin et al. | 57/142 |
| 3,487,618 | 1/1970 | Arguelles | 57/22 |
| 3,525,207 | 8/1970 | Irwin | 57/142 |
| 4,199,928 | 4/1980 | Cristaldi | 57/22 |
| 4,292,796 | 10/1981 | Mima | 57/22 |
| 4,397,140 | 8/1983 | Sheehan | 57/22 |

FOREIGN PATENT DOCUMENTS

84/00351 3/1984 World Int. Prop. O. ..... 156/181

*Primary Examiner*—Michael W. Ball
*Assistant Examiner*—Geoffrey L. Knable
*Attorney, Agent, or Firm*—Luedeka, Hodges & Neely

[57] ABSTRACT

A method and apparatus are disclosed for splicing lengths of synthetic fiber tow. The tail of one length of tow and the lead portion of another length are each separated into an equal number of bundles. Bundles from the lead portion are overlapped with bundles from the tail portion to form overlapped pairs of bundles, which pairs are confined in a pair of separate, spaced-apart, open-ended passageways. Then, the overlapped pairs in each of the pairs of passageways are subjected to a plurality of longitudinally spaced-apart jets of gaseous fluid oriented generally perpendicular to the length of the overlapped pairs. This causes fibers in the pairs of bundles from the lead portion and the tail portion to become entangled to form a splice between the lengths of full tow. With certain tows it is preferred that the direction of the jets in one of the passageways of each of the pairs of passageways is opposed to the direction of the jets in the other passageway of each of the pairs of passageways.

6 Claims, 4 Drawing Sheets

METHOD FOR SPLICING LENGTHS OF FIBER TOW

This application is a continuation of application Ser. No. 847,325, filed Apr. 2, 1986, now abandoned.

The present invention relates to splicing of fibers and more specifically relates to splicing lengths of synthetic fiber tow.

Synthetic fibers or filaments are ordinarily produced by extruding the fiber-forming material to produce a large number of individual fibers or filaments which are gathered together to form an untwisted rope known as tow. The tow is normally of an extended length and is usually packaged in boxes or other containers for shipment to processors.

Subsequent processing of the tow ordinarily is a continuous operation. This requires that the tail portion of the tow being processed from one container be joined to the lead portion of the successive tow before the length of tow being processed tails out.

Known methods of splicing tow have not been generally effective for splicing large tow, i.e., tow containing thousands of fibers, or in applications where the tow is subjected to unusual and extreme conditions. Consequently, many processors have resorted to hand-tying the lengths together. This substantially increases the bulk of the tow where the lengths are joined. This increased bulk can damage part of the tow and results in difficulty in running the knot through subsequent processing steps.

This presents a particularly serious problem in the production of carbon fibers from a precursor tow since the processing techniques are extremely sensitive to the condition and bulk of the tow. This is especially true in the oxidation and carbonization stages in carbon fiber processing. In these stages, the precursor tow is oxidized at an elevated temperature and then carbonized at a higher temperature which can reach 1500° C.

If successive tows are hand tied, the temperature of the ovens must be reduced as the knot passes through. Then, the process is stopped while the ovens are reheated. This results in production losses, increased energy consumption and destruction of material. There has been no suitable alternative to this very inefficient practice, since a knot in the tow will "flash" and cause the entire tow in the oven to burn up if the knot is exposed to the high temperatures. Various other splicing techniques have been tried but have failed, generally because of their inability to produce a splice of minimum bulk allowing the tow to maintain exothermic equilibrium during pyrolysis so that the splice does not flash in the ovens.

Accordingly, it is an object of this invention to provide a method and apparatus which can effectively splice relatively large tows. A further object is the provision of a method and apparatus that can effectively splice relatively large precursor fiber tow used in carbon fiber production in a manner which substantially eliminates the risk of the splice flashing during oxidation and carbonization.

In accordance with various features of the present invention, the method of splicing the lead and tail portions of lengths of tow includes dividing each of the lead and tail portions into a number of individual bundles. Preferably, the bundles are equal in number and each has about the same quantity of filaments. Each bundle of the lead portion is overlapped with a bundle of the tail portion to form overlapped pairs of bundles. A first portion of each pair of overlapped bundles is confined in an elongated, open-ended passageway in which the pair of bundles is subjected to a first set of spaced-apart jets of gaseous fluid. A second portion of each pair of spaced-apart bundles, which second portion is spaced from the first portion, is confined in an elongated, open-ended passageway in which the pair of bundles is subjected to a second set of spaced-apart jets of gaseous fluid. The jets are spaced along the longitudinal axis of the passageway, and are preferably all directed transversely against one side of the bundles to be spliced. In the splicing of precursor tow used in carbon fiber production it is preferred to laterally displace the portions of the bundles extending between the passageways of each pair of passageways so that these portions are substantially removed from the path of exhaust gases from the passageways. It is also preferred in splicing precursor tow that the second set of jets are oriented to direct jets of gaseous fluid in a direction generally opposite to that of the first set of jets. Thus, the pair is entangled by jets from one side at one location and by jets from the other side at another location. This operation is effected on each set of pairs to accomplish the completed splice.

Another of the features of the present invention involves the method of dividing the tow into bundles. In this method, and lead and tail portions are divided into bundles through the use of a combing device having spaced-apart teeth generally along the length of the device which is substantially longer than the width of the lead and tail portions of the tow. The device is oriented at an angle above the fibers with the outermost teeth of the device adjacent the opposite lateral edges of the tow. The teeth are passed into and through the fibers and the device is moved longitudinally. The tow is splayed into bundles by rotating the device so that it is disposed generally at right angles to the longitudinal axis of the tow.

Because a large number of bundles must be spliced to provide a splice for the entire tow, it is desirable that these be accomplished on a multiple basis. Accordingly, apparatus is provided for making multiple splices in a single operation so that the splices are uniform and so that the splicing can be done expeditiously. The apparatus which involves various features of the invention includes a splicing block which has a plurality of longitudinal passageways, access to each of which is provided by a longitudinal slot. Along each of the passageways there is provided a plurality of orifices through which jets of gaseous fluid can be directed against the pairs of bundles in each slot, and a cover is provided to seal the access slots during the entangling process.

Other objects and advantages of the invention will become known by reference to the following detailed description when considered in conjunction with the accompanying drawings in which.

Figure 1:
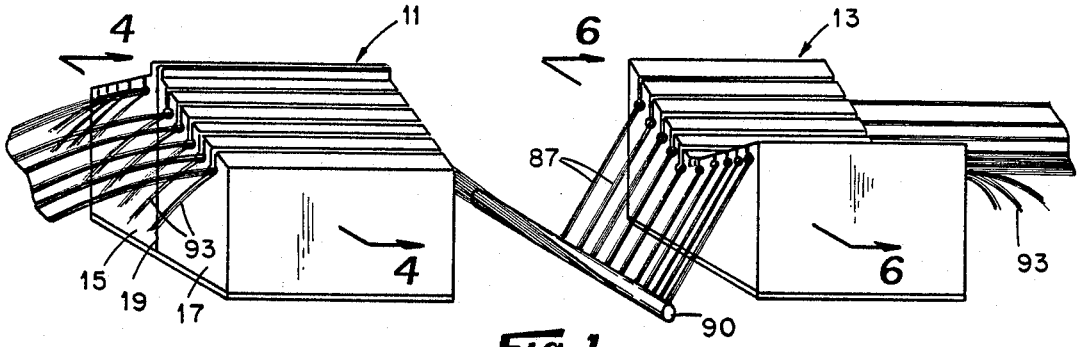
FIGS. 1 and 2 illustrate a pair of spaced-apart splicing blocks employed in practicing a preferred form of the present invention.
Figure 2:
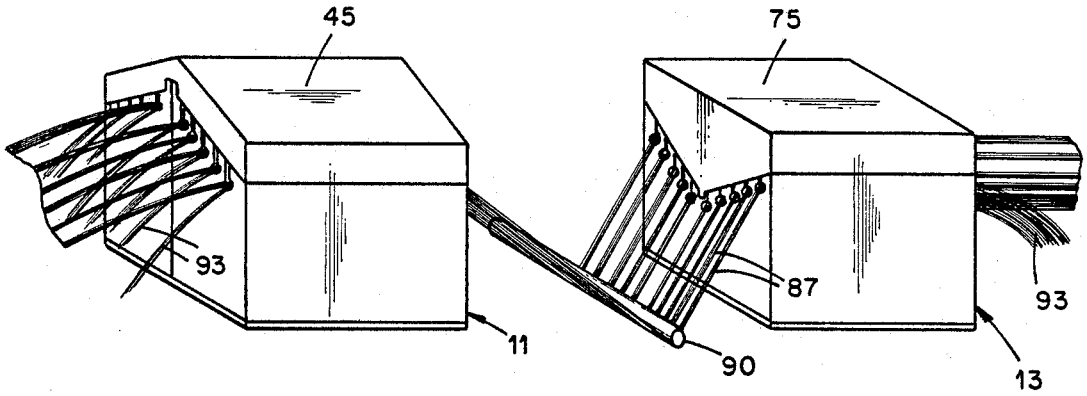

FIGS. 8*a–d* show the use of a comb having spaced-apart teeth for separating lengths of uncrimped fiber tow into bundles.

Prior to describing the details of the method, the construction of the splicing blocks will be described since the method is probably best understood with reference to the apparatus which may be preferably employed.

In FIGS. 1, 2 and 4–7 there are illustrated various features of a pair of first and second splicing blocks 11 and 13 which are adapted to deliver jets simultaneously against opposite sides of bundles of fibers which make up the splice. The first block 11 is configured so as to direct the jets against one side of the pairs of bundles to be spliced and the second block 13 is configured to direct jets against the opposite side of the pairs of bundles to be spliced. Thus, the blocks 11 and 13 are configured according to the preferred method of splicing carbon fiber precursor tow as described. In splicing bundles from tow comprised of other fibers, the jets ordinarily need not be generally oppositely directed in this manner.

The first block 11 comprises first and second sections 15 and 17 joined together along a vertical plane 19. Since the first section 15 is essentially a mirror image of the second section 17, only section 15 will be described and the reference numerals on section 17 refer to the description of section 15. As illustrated (FIG. 4), section 15 includes a vertical wall 21 and a sloping wall 23. In the sloping wall 23 there are provided a plurality of longitudinally extending cylindrical passageways 25 each of which is adapted to confine a pair of bundles of fibers. In order that the bundles may be readily inserted into each of the passageways, a longitudinally extending slot 27 is provided which extends vertically upwardly from the upper portion of each passageway 25 to an upper surface 29 of the sloping wall 23. Preferably, for optimum operation, the lateral width of the slots 27 should be about one-third of the diameter of the passageways 25.

Figure 5:
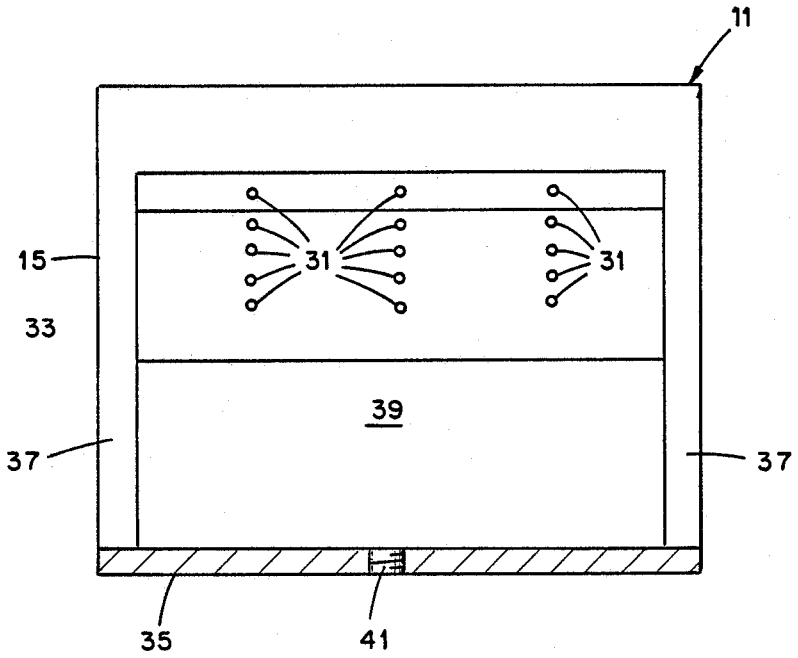
FIG. 5 is a sectional view taken along line 5—5 in FIG. 4.

A plurality of spaced-apart orifices 31 extend from an inner surface 33 of sloping wall 23 into the passageways 25. As shown in FIG. 5, three orifices 31 are provided along each of the passageways 25. Preferably, the orifices 31 are oriented to direct jets of gas normal to the axis of the passageways 25 and preferably at right angles to the vertical orientation of the slots 27. To simplify manufacture, the sloping wall 23 may be formed at an angle of 45°, the slots 27 formed by a vertical cut, and the orifices 31 drilled horizontally. Of course, other configurations may be employed to accomplish the same preferred result.

In order to form the splicing block 11, the sections 15 and 17 (Section 15's mirror image) are attached together along the plane 19 and a base plate 35 is attached to the bottom of the vertical walls 21 and end walls 37 to form a plenum 39. Pressurized air or other gaseous fluid is introduced into the plenum 39 through a fitting 41 from a source (not shown).

Figure 4:
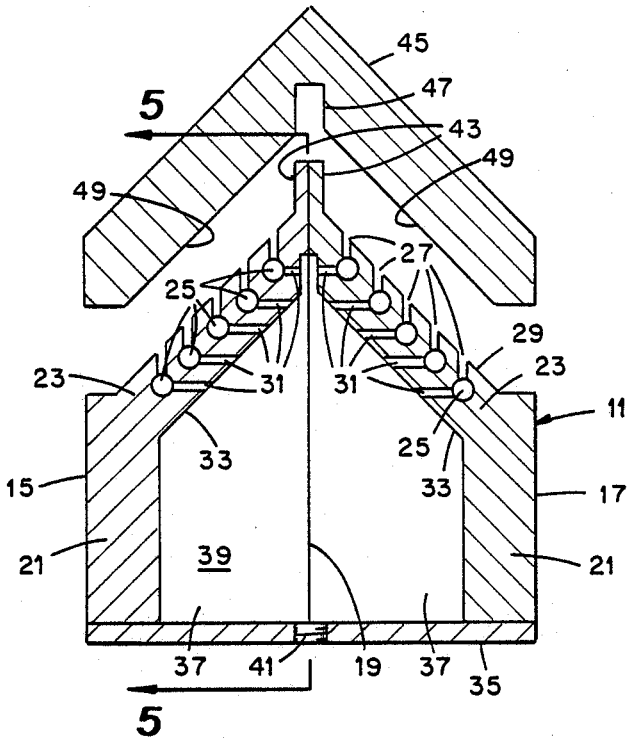
FIG. 4 is a sectional view taken along line 4—4 in FIG. 2 showing the cover in a raised position.

As shown in FIG. 4, the upper portion of the sloping wall 23 for each of sections 15 and 17 is provided with vertically extending portions 43. The portions 43 from each of the sections 15 and 17 provide a key to aid in locating a cover 45 which closes the top openings of the slots 27. The cover 45 is provided with a longitudinally extending slot 47 which fits over the key formed by the portions 43 to aid in seating the cover 45. Downwardly sloping wall surfaces 49 are provided on the bottom of the cover 45 which mate with the upper surfaces 29 on the sloping wall 23 of sections 15 and 17. Thus, after the pairs of bundles are placed in the passageways 25, the cover 45 is closed so that the leakage of air or gas through the slots 27 is minimized.

As will be noted, the orifices 31 in section 15 and the orifices 31 in section 17 generate jets in opposite directions so that the pairs of bundles in the passageways 25 in section 15 are impinged upon from one side and the pairs of bundles which are contained in the passageways 25 in section 17 are impinged upon from the other side.

Figure 6:
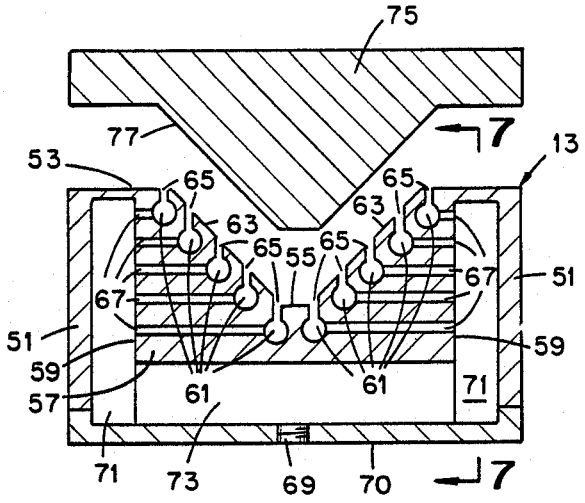
FIG. 6 is a sectional view taken along line 6—6 in FIG. 2 showing the cover in a raised position.
Figure 7:
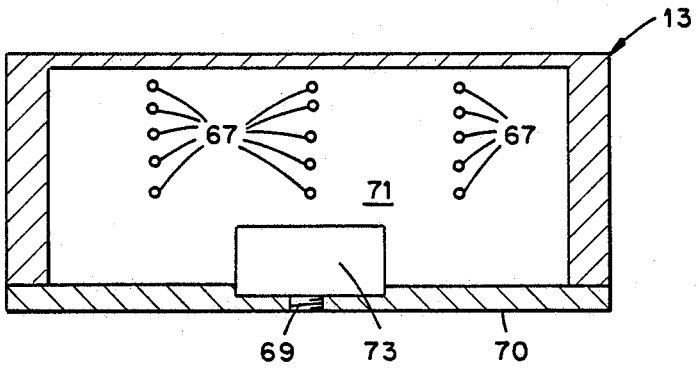
FIG. 7 is a sectional view taken along line 7—7 in FIG. 6.

The second splicing block 13 is shown in FIGS. 6 and 7. It includes generally rectangular structure having sidewalls 51 and a top wall surface 53 which includes a longitudinally extending V-shaped depression 55. Integral with the top wall 53 is a matrix 57 whose outer walls 59 are spaced inwardly of the sidewalls 51. Longitudinally extending cylindrical passageways 61 are formed in the matrix 57 under upper sloping surfaces 63 of the V-shaped depression 55. Each of the passageways 61 is adapted to confine a pair of bundles of fibers. In order that the bundles may be readily inserted into each of the passageways 61, a longitudinally extending slot 65 is provided which extends vertically upwardly from the upper portion of each passageway 61 through the upper surfaces 63 of the V-shaped depression 55. Again, the lateral width of each of the slots 65 should preferably be about one-third of the diameter of a passageway 61.

A plurality of spaced-apart orifices 67 extend through the matrix 57 into the passageways 61. As shown in FIG. 7, three orifices 67 are provided along each of the passageways 61. Preferably, the orifices 67 are oriented to direct a jet of gas normal to the axis of passageways 61 and, preferably, at right angles to the vertical orientation of the slots 65. In drilling the orifices 67, the drill may be passed through the sidewalls 51 and into the matrix 57 and the drill holes in the sidewalls then may be sealed with set screws (not shown) or the like. A fitting 69 is provided in the approximate center of a base plate 70 to admit air into plenums 71 formed between the sidewalls 51 and the matrix 57. To this end, the matrix 57 is provided with a transversely extending passageway 73 which communicates with the plenums 71 between the sidewalls 51 and the matrix 57. As will be seen, pressurized air or gas from the plenums 71 will flow into the passageways 61 on the left-hand side (FIG. 6) of the splicing block 13 from the left, and into the passageways 61 on the right-hand side from the right. Therefore, pairs of bundles in the passageways 61 on the left-hand side will have air jets impinging on opposite sides thereof than will the pairs of bundles in the passageways 61 on the right-hand side.

A cover 75 is provided having a V-shaped section 77 which mates with the V-shaped depression 55 in the top of the second block 13 to seal the top openings of the slots 65.

As pointed out above, it is desirable that the jets of gas impinge upon each pair of bundles in a direction normal to the axis of the passageways 61 and, preferably, at right angles to the vertical orientation of the slots 65. Thus, if the V-shaped depression 55 in the top of block 13 is formed at a 90° angle, the slots 65 can be formed by a vertical cut and the orifices can be drilled horizontally to simplify manufacture. Of course, other configurations can be employed to accomplish this result.

In the following there will be described a preferred manner of carrying out the method of splicing lengths of a 200,000 total denier tow of polyacrylonitrile (PAN) fibers for use in carbon fiber production. The individual fibers are about 2.00 denier so that there are about 100,000 individual filaments in the tow. The PAN fiber tow is heavily crimped.

In carrying out the process the tow is divided into discrete bundles, each containing about 1,000 total denier or about 5,000 filaments which are interconnected by splicing. The dividing of the tow need not be precise but it is desirable that the individual bundles be of approximately the same total denier.

Figure 8A:
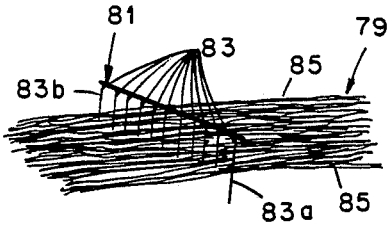
Figure 8B:
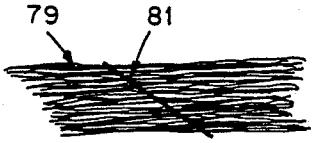
Figure 8C:
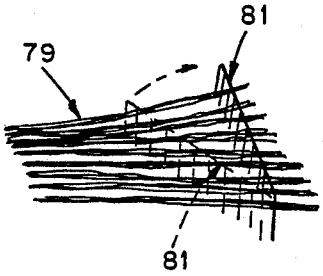
Figure 8D:
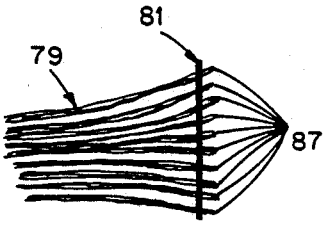

It has been found that a convenient manner of separating a length of tow 79 is by the employment of a comb 81 for splitting the tow. In this regard, FIGS. 8*a–d* illustrate a preferred manner of separating the tow. The comb 81 has length of which is substantially longer than the width of the tow 79 so that it can be placed at an acute angle relative to the longitudinal axis of the tow (see FIGS. 8*a* and 8*b*). The comb 81 includes a predetermined number of prongs or teeth 83 which are long enough to penetrate the tow. The length of the comb is determined so that the outermost teeth 83*a* and 83*b* can be positioned along the lateral edges 85 of the tow 79 when the comb 81 is in the acute angle position. In the process, the separation into discrete bundles is effected for about a three foot length of the tail of the leading tow and for about three feet on the lead of the trailing tow. As shown in FIG. 8*a*, the comb 81 includes 11 teeth (which will divide the filaments in the section being treated into ten bundles). The comb 81 is placed about three feet from the terminal end of the tow being separated with the outermost teeth 83*a* and 83*b* adjacent the lateral edges of the tow whereupon the comb 81 is pulled through the tow and then rotated from the acute angled position, as shown in FIG. 8*c* in dotted outline, into the position shown by the solid outline in FIG. 8*c*, resulting in 10 spaced apart bundles 87 (see FIG. 8*d*).

In handling the 200,000 denier tow for splicing it is preferable to subdivide the tow in a series of steps. For example, the two can be divided into four discrete groups with a five toothed comb as described above, to provide groups of about 50,000 denier. Then each of these groups are divided by a six toothed comb to provide portions of each group containing 10,000 total denier. Then each of these groups can be divided into ten bundles with an eleven toothed comb as described above, each containing about 1,000 denier.

Because the PAN tow is crimped, the crimp should be removed to provide optimum splicing. This is accomplished by placing the three foot lead and tail portions in a steam box where it is subjected to saturated steam to relax the crimp after which the steamed portion, while heated, is stretched to straighten out the crimp. Preferably, this is done at the point where the portion of the tow being steamed contains about 10,000 denier, prior to employing the comb 81, since the tow can be straightened under tension more readily. However, the tail and lead portions of the tow can be steamed and straightened in larger groups with somewhat less efficient results.

The first and second blocks 11 and 13 are placed in spaced-apart, longitudinal alignment, as shown in FIG. 1, and a bundle 87 of approximately 1,000 total denier from the lead portion of the trailing tow is placed in one of the passageways 25 in the first block 11 and one of the passageways 61 in the second block 13 through the associated slots 27 and 65. This is repeated until each of the passageways 25 and 61 in the blocks 11 and 13 is filled with a bundle 87 of the trailing tow.

Then, an approximately 1,000 denier bundle 87 from the tail of the leading tow is similarly placed, one in each of the passageways 25 and 61 in the blocks 11 and 13, through the associated slots 27 and 65. Thus, each of the passageways 25 and 61 includes a pair of bundles 87, one of the bundles 87 being from the leading tow and the other bundle 87 being from the trailing tow (Only one pair of bundles 87 is indicated by reference numbers in FIGS. 1 and 2 for clarity). After the bundles 87 are placed in the passageways 25 and 61, a laterally positioned rod 90 is brought into contact with portions of the bundles 87 which extend between the blocks 11 and 13 to equalize their lengths so that the splice, when completed, will draw in subsequent processing steps in a relatively flat, uniform manner. The rod 90 also displaces the sections of each of the bundles between the blocks 11 and 13 out of the path of exhaust gases from the passageways 25 and 61 in the blocks 11 and 13, and holds the bundles against the bottom of the outer circumferential edge of the open ends of the passageways 25 and 61 adjacent the displaced portions.

Figure 3:
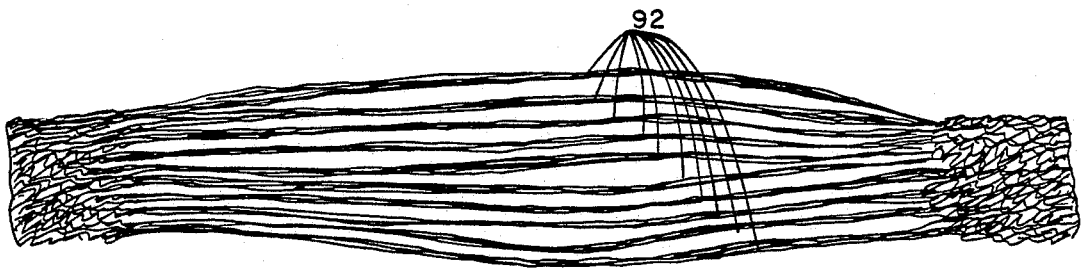
FIG. 3 illustrates a splice formed between lengths of tow.

The covers 45 and 75 for the blocks 11 and 13, respectively, are placed over the upper surface of the blocks 11 and 13 and are locked in place by suitable means (not shown) to minimize airflow out of the slots 27 and 65. After the covers 45 and 75 are locked, pressurized air between about 110 to 150 psi, preferably about 120 psi, is admitted to the plenums 39 and 71 for two or three seconds, after which, the covers 45 and 75 are removed and spliced pairs of bundles 92 (see FIG. 3) are removed. Any tails from the bundles 87 such as is shown at 93 in FIGS. 1 and 2 (only two of which are indicated by reference numbers for clarity), may be cut off and the process repeated on other bundles until the tow is completely spliced (see FIG. 3).

The blocks 11 and 13 for splicing the above-described tow have passageways 25 and 61 which are each about four inches long and have a diameter of about 3/16 inches. The slots 27 and 65 to the passageways 25 and 61 have a width of approximately 1/16 inches and the orifices 31 and 67 are preferably drilled with a number 60 drill.

Three orifices 31 and 67 are employed in each passageway 25 and 61 and are spaced approximately one inch from each other, and from the ends of the passageways 25 and 61.

The splice which results has sufficient strength to be carried through normal processing conditions, and because of the opposite orientation of the jets produced from the orifices 31 and 67 imparts minimum twist to the individual splices which is believed to be of importance in enhancing the strength and characteristics of the splice.

The method and apparatus of the invention is equally useful in splicing relatively large tows of various types of filaments; e.g., polypropylene, nylon, fiberglass, etc. With those filaments, decrimping is usually not necessary since the filaments are not ordinarily crimped excessively. Also, depending upon the fiber, the use of the rod 90 may not be necessary if high uniformity is not a requirement for the splice.

Various features of the invention which are believed to be new are set forth in the following claims.

What is claimed is:

1. A method of splicing the lead and tail portions of lengths of fiber tow, comprising:

dividing each of the lead and tail portions into a plurality of separate bundles;

overlapping bundles of the lead portions with bundles of the tail portions to form overlapped pairs of bundles;

providing a plurality of pairs of separate, longitudinally spaced-apart, open-ended cylindrical passageways;

confining each of the overlapped pairs of bundles in one of said pairs of separate, longitudinally spaced-apart, open-ended cylindrical passageways; and subjecting the overlapped pairs in each passageway of each pair of passageways to a plurality of longitudinally spaced-apart jets of gaseous fluid oriented generally perpendicularly to the length of the overlapped pairs, the jets being directed substantially at the longitudinal axes of the passageways and the jets in one passageway of each of said pairs of passageways being generally oppositely directed relative to the jets in the other passageway, whereby fibers in the pairs of bundles from the lead portion and from the tail portion become entangled to form a splice between the lengths of fiber tow.

2. The method of claim 1, wherein the lead and tail portions are divided into an equal number of bundles, each bundle having about the same quantity of fibers.

3. The method of claim 1 or 2, further comprising laterally displacing the portion of each of the overlapped pairs extending between the pairs of passageways so that the displaced portions are substantially removed from the flow of air exiting through the open ends of the passageways adjacent the laterally displaced portions.

4. The method of claim 1, wherein a plurality of pairs of bundles are processed simultaneously.

5. The method of claim 1, wherein the division of tow is accomplished by passing a plurality of substantially equally spaced-apart teeth through the tow along a line at an acute angle to the length of the tow with the outermost teeth being located outside of and adjacent the lateral edges of the tow, moving said teeth longitudinally through the tow, and rotating said teeth into an alignment across the tow whereby the tow is splayed into discrete portions of approximately equal substance.

6. A method of splicing lengths of crimped fiber tow, comprising:

removing the crimp from the lead portion of one length of crimped fiber tow and from the tail portion of another length of crimped fiber tow;

dividing each of the uncrimped lead and tail portions into a plurality of separate bundles, each bundle having about the same quantity of uncrimped fibers;

overlapping each bundle of the lead portion with a bundle of the tail portion to form overlapped pairs of bundles;

providing a plurality of pairs of separate, longitudinally spaced-apart, open-ended cylindrical passageways;

confining each of the overlapped pairs of bundles in one of said pairs of separate, longitudinally spaced-apart, open-ended cylindrical passageways; and subjecting the overlapped pairs in each passageway of each pair of passageways to a plurality of longitudinally spaced-apart jets of gaseous fluid oriented generally perpendicular to the length of the overlapped pairs, the jets being directed substantially at the longitudinal axes of the passageways and the jets in one passageway of each of said pairs of passageways being generally oppositely directed relative to the jets in the other passageway, whereby fibers in the pairs of bundles from the lead portion and tail portion become entangled to form a splice between the lengths of the fiber tow.

* * * * *